US008104216B2

(12) United States Patent
Uhm

(10) Patent No.: US 8,104,216 B2
(45) Date of Patent: Jan. 31, 2012

(54) INTEGRATED CONTROL SYSTEM AND METHOD FOR CONTROLLING AIMED SHOOTING OF SNIPER AND OBSERVATION OF SPOTTER

(75) Inventor: Hyun Duk Uhm, Seoul (KR)

(73) Assignee: ID. Fone Co., Ltd., Seoul (KR)

( * ) Notice: Subject to any disclaimer, the term of this patent is extended or adjusted under 35 U.S.C. 154(b) by 54 days.

(21) Appl. No.: 12/823,113

(22) Filed: Jun. 24, 2010

(65) Prior Publication Data

US 2011/0173869 A1 Jul. 21, 2011

(30) Foreign Application Priority Data

Jan. 15, 2010 (KR) ..... 10-2010-0003843

(51) Int. Cl.
*F41G 1/00* (2006.01)

(52) U.S. Cl. ..... 42/111; 42/118; 42/119; 89/28.05; 89/28.2; 89/41.17; 89/1.11

(58) Field of Classification Search ..... 42/111, 42/118, 119; 89/28.05, 28.2, 41.17, 1.11; 434/17
See application file for complete search history.

(56) References Cited

U.S. PATENT DOCUMENTS 1,438,833 A * 12/1922 Kaminski ..... 89/28.05
3,711,638 A * 1/1973 Davies ..... 348/143
4,205,589 A * 6/1980 Engler et al. ..... 89/41.07
4,256,013 A * 3/1981 Quitadama ..... 89/41.05
4,267,562 A * 5/1981 Raimondi ..... 348/144
5,834,676 A * 11/1998 Elliott ..... 89/41.05
7,121,464 B2 * 10/2006 White ..... 235/400
7,654,029 B2 * 2/2010 Peters et al. ..... 42/111
7,677,893 B2 * 3/2010 Lvovskiy ..... 434/21
7,690,145 B2 * 4/2010 Peters et al. ..... 42/111
2008/0092727 A1 * 4/2008 Glascock ..... 89/27.3
2009/0320348 A1 * 12/2009 Kelly ..... 42/119
2010/0282845 A1 * 11/2010 Peters et al. ..... 235/414

* cited by examiner

*Primary Examiner* — Michelle Clement
(74) *Attorney, Agent, or Firm* — Hershkovitz & Associates, LLC; Abraham Hershkovitz

(57) ABSTRACT

The present invention relates to a system and method for controlling the aimed shooting of a sniper and the observation of a spotter. At the same time that a sniper directly checks the shape of the target using a sighting telescope, a spotter observes the surroundings of the target using an observatory telescope. The sniper deflects images of the target using a prism, focuses the images, and converts the focused images into digital moving image signals. The spotter deflects images of the target using a prism, focuses the images, and converts the focused images into digital moving image signals. Two types of images can be selectively transmitted, or can be combined with each other using a multiplexer and transmitted to a shooting controller in a multi-screen division form. A commanding office can identify a precise target and make a decision pertaining to shooting.

17 Claims, 11 Drawing Sheets

INTEGRATED CONTROL SYSTEM AND METHOD FOR CONTROLLING AIMED SHOOTING OF SNIPER AND OBSERVATION OF SPOTTER

CROSS-REFERENCE TO RELATED APPLICATIONS

The present application claims priority under 35 U.S.C. 119 of Korean Patent Application No. 10-2010-0003843, filed on Jan. 15, 2010, the disclosure of which is expressly incorporated by reference herein in its entirety.

BACKGROUND OF THE INVENTION

1. Field of the Invention

The present invention relates, in general, to an integrated control system and method for controlling the aimed shooting of a sniper and the observation of a spotter, and, more particularly, to an integrated control system and method for controlling the aimed shooting of a sniper and the observation of a spotter, in which the sniper, who aims at a target with a firearm and will shoot at the target, directly checks the shape of the target using a sighting telescope while a spotter observes the surroundings of an area around the target using an observatory telescope, and then determines whether the current location of the sniper is safe and whether the target has been precisely hit after the sniper has shot at the target and also detects the state of the changing surroundings of the target, so that two types of moving images captured by the sniper and the spotter can be selectively transmitted by the sniper or spotter by manipulating the channel switches of a wireless control transmission unit, and the moving images obtained by two types of channels can be combined with each other using a multiplexer and can be transmitted in real time to the shooting controller of a commanding office located at a remote place through the wireless control transmission unit while the combined images are viewed on a small-sized monitor in a multi-screen division form, and in which the commander of the commanding office at the remote place receives in real time the moving images of the target at a spot and also receives reports on the surroundings of the spot in the form of moving images via the reception monitor of a control unit and can precisely check the target and make a decision pertaining to shooting.

2. Description of the Related Art

Generally, among sighting devices used for military purposes, there are sighting telescopes provided to aim at targets on the barrels of firearms, including large-scale firearms as well as personal firearms, periscopes provided to observe external environment in large-scale firearms, and observatory telescopes of variable magnification for viewing by the spotter.

To date, when a sniper identifies a target using his or her firearm equipped with a sighting telescope and reports the situation of the identification of the target using a radio, a commander at the remote place schematically grasps the situation of a spot. Thereafter, when the commander issues a command to shoot using a radio, the sniper shoots at the target.

In addition, since the sniper reports the situation related to operations which have been made in an area outside the visible range of the commander, via voice communication using a radio, it is difficult for the commander located at the remote place to precisely grasp the current situation of the spot.

In this way, many problems related to complications and operations due to commands issued by the commander in the state in which he or she has not directly viewed the situation of a spot at the time of issuing the commands may occur in current systems in which the commander in the commanding office located at the remote place cannot precisely detect information about whether a sniper is located at a designated place securing a field of vision, whether the sniper has precisely identified the target, and whether the sniper has precisely aimed at the target using a sighting telescope and intends to shoot at the target, and in which the commander at the remote place merely listens to the description of the surroundings of the spot provided by a spotter, who performs his or her duty for reporting the situation of reconnaissance on the surroundings, using voice information based on a radio and issues a shoot command using the radio.

SUMMARY OF THE INVENTION

Accordingly, the present invention has been made keeping in mind the above problems occurring in the prior art, and an object of the present invention is to provide an integrated control system and method for controlling the aimed shooting of a sniper and the observation of a spotter, which form image signals corresponding to the same real-time moving images viewed by both a sniper who aims at a target with a firearm and will shoot at the target, and a spotter who widely grasps the safety of the place where the sniper is disposed and the surroundings of the target, and then observes a situation indicating whether the sniper has precisely hit the target at the time of shooting at the target while preventing the sniper's position from being leaked to the other party in such a way that image signals are formed by a sniper optical unit composed of an optical device and a camera which are attached to the outside of a sighting telescope mounted on the firearm of the sniper, and that image signals are formed by a spotter optical unit composed of an optical device and a camera which are attached to the outside of the observatory telescope of the spotter, so that two types of video captured by the sniper and the spotter can be selectively transmitted by the sniper or spotter by manipulating the channel switches of a wireless control transmission unit, and the video obtained by the two types of channels can be combined with each other using a multiplexer and can be transmitted in real time to the shooting controller of a commanding office located at a remote place through the wireless control transmission unit while the combined images are viewed on a small-sized monitor in a multi-screen division form, and which allows a commander in a commanding office to view the moving images so as to make a precise decision pertaining to shooting while sharing images of the spot in real time with the sniper and the spotter, and remotely controls shooting by controlling whether to release the trigger locking unit of the sniper's firearm at the remote place.

In order to accomplish the above object, the present invention provides an integrated control system for controlling aimed shooting of a sniper and observation of a spotter, comprising a sighting camera unit for allowing a sniper, who aims at a target with a firearm and will shoot at the target, to check a shape of the target formed by a sighting telescope while viewing the shape through a second eyepiece, for deflecting images of the target using a first prism of a reflection optical unit closely located on a first side of a first eyepiece of the sighting telescope at an angle of 90°, for focusing the images using a camera lens, and for generating image signals using an image conversion module; an observation camera unit for allowing a spotter, who widely grasps safety of a place where the sniper is disposed and surroundings of the target and observes whether the sniper has precisely hit the target at a time of shooting at the target while preventing the sniper's position from being leaked to another party, to identify the target and the surroundings of the target using an observatory telescope while viewing them through a first eyepiece, for deflecting images of the target and the surroundings at an angle of 90° using a first prism of a reflection optical unit closely located on a first side of an observation magnification lens, for focusing the images using a camera lens, and for generating image signals using an image conversion module; a multiplexer for allowing two types of video acquired by the sighting camera unit and the observation camera unit to be selectively transmitted by the sniper or the spotter by manipulating channel selection switches of a wireless control transmission unit, and dividing video obtained through two channels into images for multiple screens; the wireless control transmission unit for transmitting digital video in real time to a shooting controller of a commanding office at a remote place through a wireless video transmitter while the moving images are viewed on a small-sized monitor of the wireless control transmission unit; a shooting controller disposed in a control unit of the commanding office at the remote place and configured to receive video of the target aimed at by the sniper and moving images of a situation of a spot captured by the spotter; the control unit for transmitting a trigger lock release signal in a wireless manner when a commander of the commanding office makes a precise decision pertaining to shooting and then presses an approval button of the shooting controller while issuing a shoot command via remote control; and a trigger locking unit for controlling an electromagnetic lock, which has blocked pulling of a trigger of the firearm using a force of an electromagnet, when the wireless control transmission unit receives the trigger lock release signal from the shooting controller.

Further, the present invention provides an integrated control method of controlling aimed shooting of a sniper and observation of a spotter, comprising disposing a sniper who identifies a location of a target and will shoot at the target while aiming at the target with a firearm; allowing the sniper to aim at the target while viewing a magnified image of the target using a second eyepiece of a sighting camera unit attached to a sighting telescope provided on the firearm; allowing the sniper to identify the target using the second eyepiece and collect images of the target, transmitting part of the images of the target to a camera lens through a first prism of a reflection optical unit of the sighting camera unit, and allowing an image conversion module to convert the images of the target into digital video signals; locating the prism on a first side of a first eyepiece of the sighting telescope by which the sniper identifies the target, receiving images of the target corresponding to part of light and deflecting the images at an angle of 90° using the prism, allowing the camera lens to receive the images of the target, directly provided by the prism, allowing the image conversion module to convert analog video into digital video signals, and transmitting the digital moving video signals of the target to a shooting controller of a commanding office located at a remote place through a wireless control transmission unit; connecting a shooting unit connected to the wireless control transmission unit and a control unit located at the remote place to each other so that images/sound and shooting control signals therebetween are bidirectionally communicated in real time; outputting the images of the target on a Liquid Crystal Display (LCD) monitor of the shooting controller and enabling the images of the target to be viewed in real time by the control unit; the control unit determining whether to approve or disapprove shooting in such a way that a commander detects a precise location of the target and is aware of a time of shooting while viewing the images of the target on the LCD monitor of the shooting controller, and then transmitting a shooting approval signal to the wireless control transmission unit of the shooting unit; when the commander presses an approval button provided on a portion of the shooting controller, transmitting a shoot approval command to the sniper; when the control unit issues a shoot command, transmitting the shoot command to an electromagnetic control mounted on the firearm through the wireless control transmission unit; and the electromagnetic control transmitting a radio release signal in compliance with the shoot approval command, and retreating an electromagnetic lock of a trigger locking unit from its locked position, so that the sniper views a turn-on operation of a release indication lamp and shoots at the target in a locking release state by pulling the trigger.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
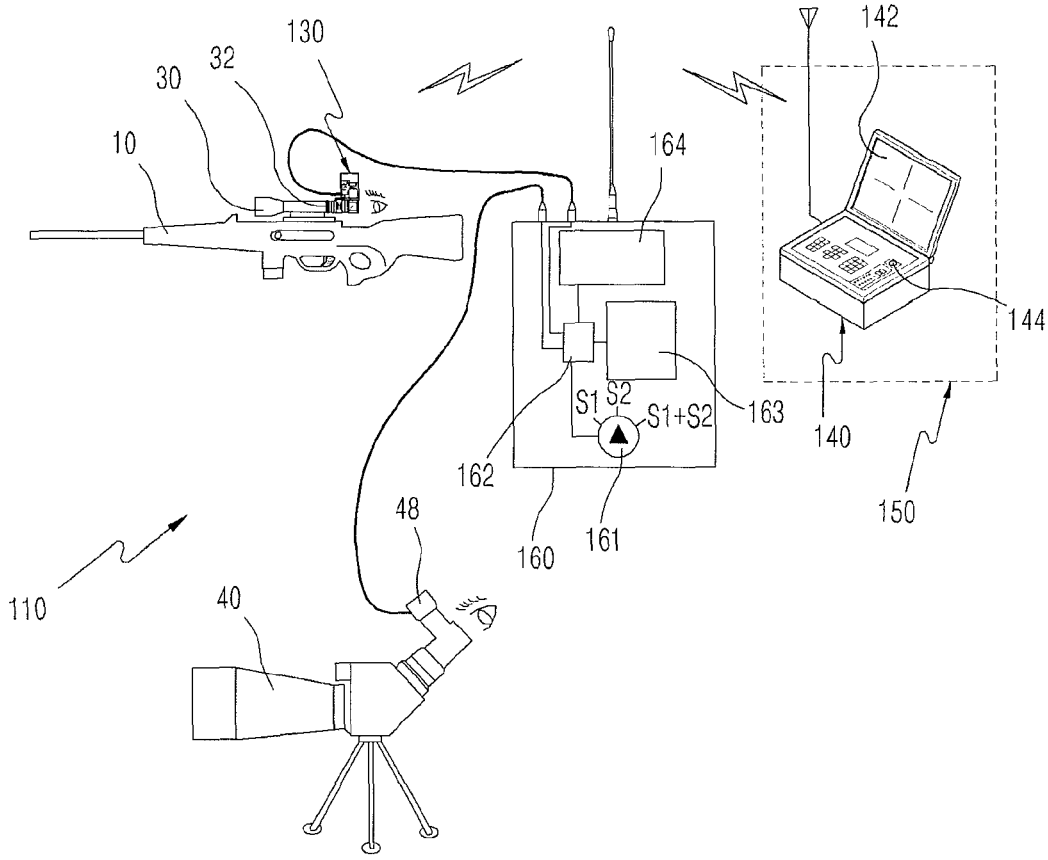
FIG. 1 is a conceptual diagram showing an integrated control system for controlling the aimed shooting of a sniper and the observation of a spotter according to the present invention.

In order to accomplish the object, the present invention provides an integrated control system for controlling the aimed shooting of a sniper and the observation of a spotter, including a shooting unit, a sighting camera unit, an observation camera unit, a wireless control transmission unit, a shooting controller, a control unit, and a wireless image transmitter. The shooting unit is configured such that both a sniper and a spotter are located adjacent to each other, wherein the sniper aims at a target with a firearm and shoots at the target, and the spotter widely grasps the safety of the place where the sniper is disposed and the surroundings of the target and then observes, using an observatory telescope, the situation related to whether the sniper has precisely hit the target at the time of shooting at the target while preventing the position of the sniper from being leaked to the other party.

The sighting camera unit is mounted on one side of the eyepiece of a sighting telescope by which the sniper aims at the target while viewing a magnified image of the target, and is configured to include a reflection optical unit composed of a prism (or a half mirror) and a camera lens and also to generate images of the target, identified by the sniper while viewing through the camera lens, in the form of digital moving image signals.

The observation camera unit is mounted on one side of the observation magnification lens of the observatory telescope by which the spotter aims at the target while viewing a magnified image of the target, and is configured to include a reflection optical unit composed of a prism (or a half mirror) and a camera lens and an image conversion module configured to convert an analog image indicating the surroundings of the target identified by the spotter and an analog image indicating whether the target has been shot into digital video signals.

The wireless control transmission unit is configured such that two types of moving images captured by the sighting camera unit and the observation camera unit can be selectively transmitted by the sniper or the spotter by manipulating the channel selection switches of the wireless control transmission unit, and such that the two types of moving images obtained by two types of channels can be combined with each other by a multiplexer and the combined digital video signals can be transmitted in real time to a commanding office located at a remote place while being viewed on a small-sized monitor in a multi-screen division form.

The shooting controller allows the images of the target at the spot and video of the surroundings of the target, which are received by the commanding office at the remote place, to be viewed in real time via the Liquid Crystal Display (LCD) monitor of the shooting controller in a multi-screen form.

The control unit checks the images of the precise target using the shooting controller, and transmits a shoot approval command while transmitting a trigger lock release signal to the shooting unit in a wireless manner.

The wireless video transmitter connects the shooting unit and the control unit located at the remote place to each other so that video/audio GPS metadata therebetween can be bidirectionally communicated in real time.

Hereinafter, embodiments of the present invention will be described in detail with reference to the attached drawings.

Prior to giving the description, the terms and words used in the present specification and claims should not be interpreted as being limited to their typical meaning based on the dictionary definitions thereof, but should be interpreted to have the meaning and concept relevant to the technical spirit of the present invention, on the basis of the principle by which the inventor can suitably define the implications of terms in the way which best describes the invention.

Therefore, an embodiment described in the present specification and the construction shown in the drawings are related to only a preferred embodiment of the present invention, and do not represent all of the technical spirit of the present invention. Accordingly, it should be understood that various equivalents and modifications capable of replacing the embodiment and the construction may be present at the time at which the present invention was filed.

FIG. 1 is a conceptual diagram showing an integrated control system for controlling the aimed shooting of a sniper and the observation of a spotter according to the present invention.

As shown in the drawing, the integrated control system for controlling the aimed shooting of a sniper and the observation of a spotter according to the present invention allows both a sniper who conducts shooting at a spot and a commanding office located at a remote place to mutually and precisely sight a target and enables shooting to be conducted at the optimal time point by controlling aiming and shooting. Further, the integrated control system widely grasps the safety of the place where the sniper is disposed and the surroundings of the target, and thus allows the commanding office at the remote place to directly view the operational situation of the spot, indicating whether the sniper precisely hit the target at the time of shooting at the target, in the form of real-time video and to perform wireless remote control while preventing the position of the sniper from being leaked to the other party.

That is, as shown in FIGS. 2 to 6, the integrated control system is configured in detail as follows. A sighting camera unit 130 is configured such that a sniper, who aims at a target 20 with a firearm 10 and will shoot at the target 20, checks the shape of the target formed by a sighting telescope 30 while personally viewing the shape of the target through a second eyepiece 33. Further, the sighting camera unit 130 deflects images of the target 20 using the prism 122 (or half mirror) of a reflection optical unit 120, closely located on one side of the eyepiece 32 of the sighting telescope, at an angle of 90°, focuses the images using a camera lens 124, and then generates image signals using an image conversion module 126. An observation camera unit 48 is configured such that a spotter, who widely grasps the safety of the place where the sniper is disposed and the surroundings of the target 20 and then observes whether the sniper has precisely hit the target 20 at the time of shooting at the target 20 while preventing the position of the sniper from being leaked to the other party, checks the target 20 and the surroundings of the target 20 using an observatory telescope 40 while personally viewing them through the eyepiece 33 of the observatory telescope 40. Further, the observation camera unit 48 deflects images of the target 20 and the surroundings thereof using the prism 122 (or half mirror) of a reflection optical unit 120, closely located on one side of an observation magnification lens 43, at an angle of 90°, focuses the images using a camera lens 124, and then generates image signals using an image conversion module 126. A wireless control transmission unit 160 allows the two types of moving images acquired by the sighting camera unit 130 and the observation camera unit 48 to be selectively transmitted by the sniper or the spotter by manipulating the channel selection switches 161 (S1, S2 and S1+S2) of the wireless control transmission unit 160. Further, the wireless control transmission unit 160 allows the video obtained by two types of channels to be combined with each other by a multiplexer 162 and to be transmitted in the form of digital video signals in real time to the shooting controller of a commanding office located at the remote place through a wireless video transmitter 164 while the combined moving images are viewed on a small-sized monitor 163 in a multi-screen division form. In a shooting unit 110, the sniper is disposed to be provided with the firearm 10, the sighting telescope 30, the sighting camera unit 130, and peripheral devices, and the spotter is disposed to be provided with the observatory telescope 40, the observation camera unit 48, peripheral devices, and the wireless control transmission unit 160.

The control unit 150 of the commanding office at the remote place can view video of the target 20 aimed at by the sniper in a multi-screen form in real time, and then receives a report on the situation of the spot in the form of video. In this case, when a commander makes a precise decision pertaining to shooting, and then presses an approval button 144 on the shooting controller 140 while issuing a shoot command via remote control, the wireless control transmission unit 160 receives a trigger lock release signal from the shooting controller 140 in a wireless manner. At the same time that the trigger lock release signal is transferred to the electromagnetic coil control 172 of the trigger locking unit 170 attached to the firearm 10, an electromagnetic coil lock 174 which has blocked the pulling of the trigger 12 using the force of an electromagnet coil retreats from its locked position, and then a trigger locking function is released. In addition, the commanding office at the remote place can control shooting at the spot by remote control in such a way that, when a release indication lamp 127 located on the top of the second eyepiece 33 of the sighting camera unit 130 is turned on, the sniper recognizes that the trigger locking unit 170 has been released and then shoots at the target by pulling the trigger 12.

The shooting unit 110 and the control unit 150 located at the remote place are connected to each other so that video/audio/control signals therebetween are bidirectionally communicated in real time via the wireless control transmission unit 160 and the shooting controller 140.

Meanwhile, the present invention is provided with transmission equipment for video/audio GPS metadata, including a wireless control transmission unit 160. The wireless control transmission unit 160 can receive individual video through two or more types of channels of the sighting camera unit 130 and the observation camera unit 48 and can selectively transmit the video by manipulating the channel selection switches S1, S2, Sn, S1+S2, S1+S2 and S1+Sn. Further, the wireless control transmission unit 160 can transmit digital video signals in real time to the commanding office at the remote place at a distance of from several km to several hundreds of km by using a multiplexer 162, capable of dividing the video received through the two or more types of channels into images for multiple screens, and a wireless video transmitter 164 while the digital video signals are viewed on the small-sized monitor 163 of the wireless control transmission unit, when the sniper is moving and loaded on a helicopter, an airplane, a land transportation means, a patrol boat, or a ship.

Figure 11:
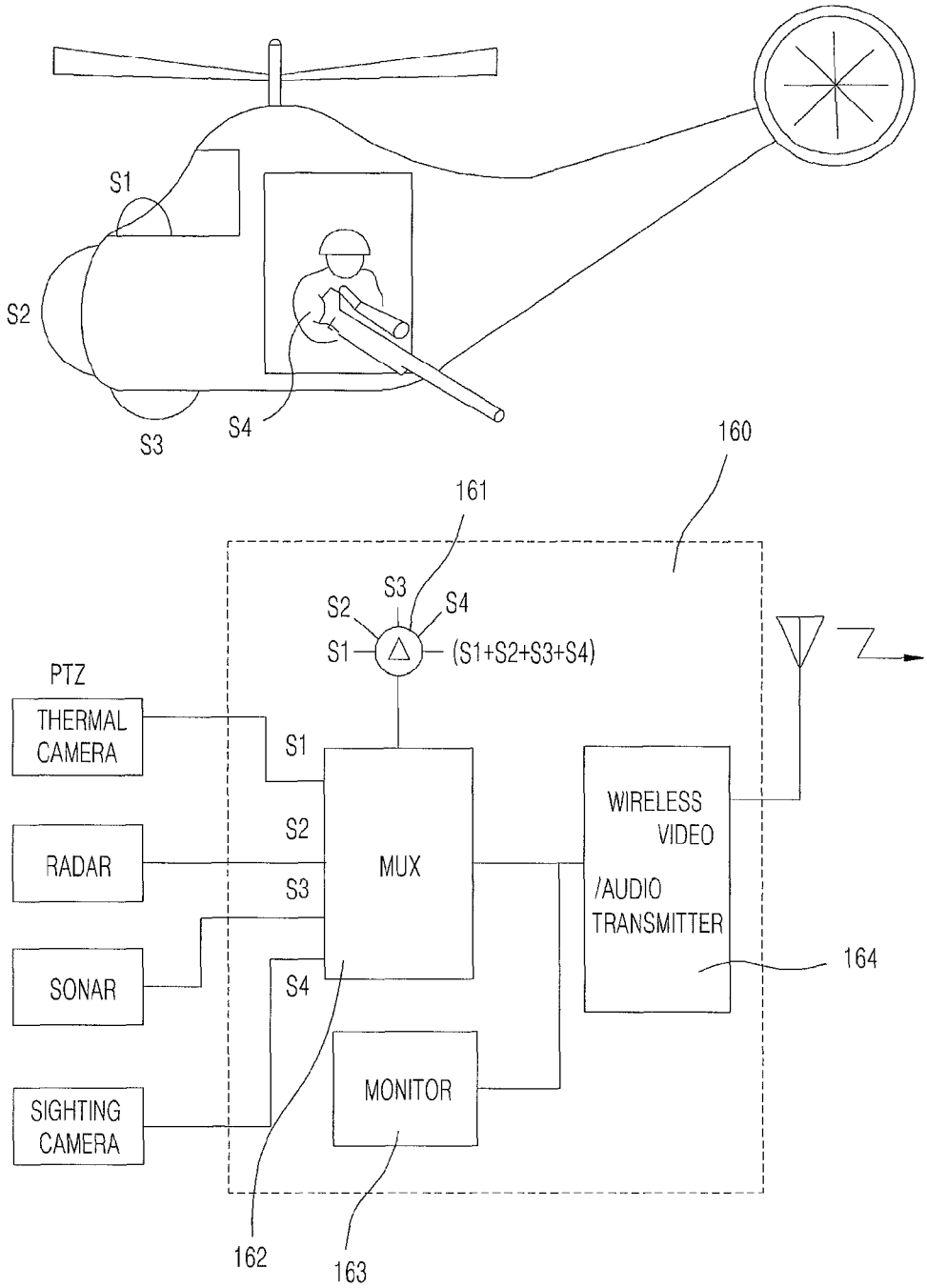
FIG. 11 is a detailed diagram showing the state in which a sniper gets on a helicopter or an airplane and conducts an operation in the integrated control system for controlling the aimed shooting of a sniper and the observation of a spotter according to yet another embodiment of the present invention.

In detail, as shown in FIG. 11, the wireless control transmission unit 160 is configured such that when Radio Detection And Ranging (RADAR) equipment, Sound Navigation and Ranging (SONAR) equipment for sound wave measurement, a Pan Tilt Zoom (PTZ) camera, an infrared camera or a thermal camera is mounted in a helicopter or an airplane, and a sniper gets on the helicopter or the airplane and conducts an operation, video can be received through multiple channels and can be selectively transmitted by manipulating channel selection switches, and the multi-channel video S1, S2, S3 and S4 can be separately transmitted, or selectively transmitted using the multiplexer 162 capable of dividing the video into images for multiple screens, and such that the digital video signals are transmitted in real time to the commanding office located at the remote place at a distance of from several km to several hundreds of km, through the wireless video transmitter 164 while being viewed on the small-sized monitor 163 of the wireless control transmission unit 160.

Hereinafter, the integrated control system for controlling the aimed shooting of a sniper and the observation of a spotter, having the above construction, will be described in detail with reference to the attached drawings.

Figure 2:
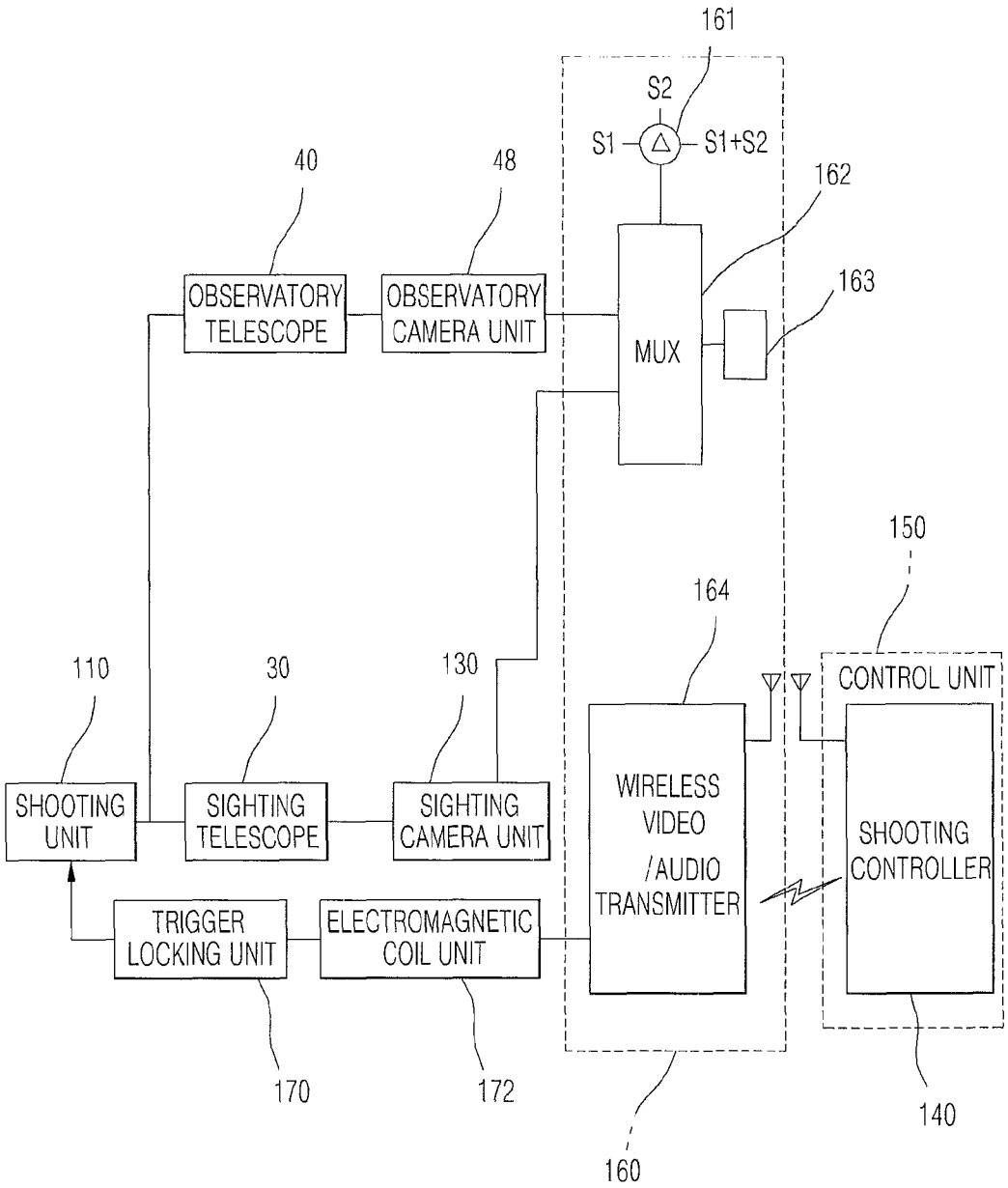
FIG. 2 is a block diagram showing the overall construction of the integrated control system for controlling the aimed shooting of a sniper and the observation of a spotter according to the present invention.

FIG. 2 is a block diagram showing the overall construction of the integrated control system for controlling the aimed shooting of a sniper and the observation of a spotter according to the present invention.

Figure 3:
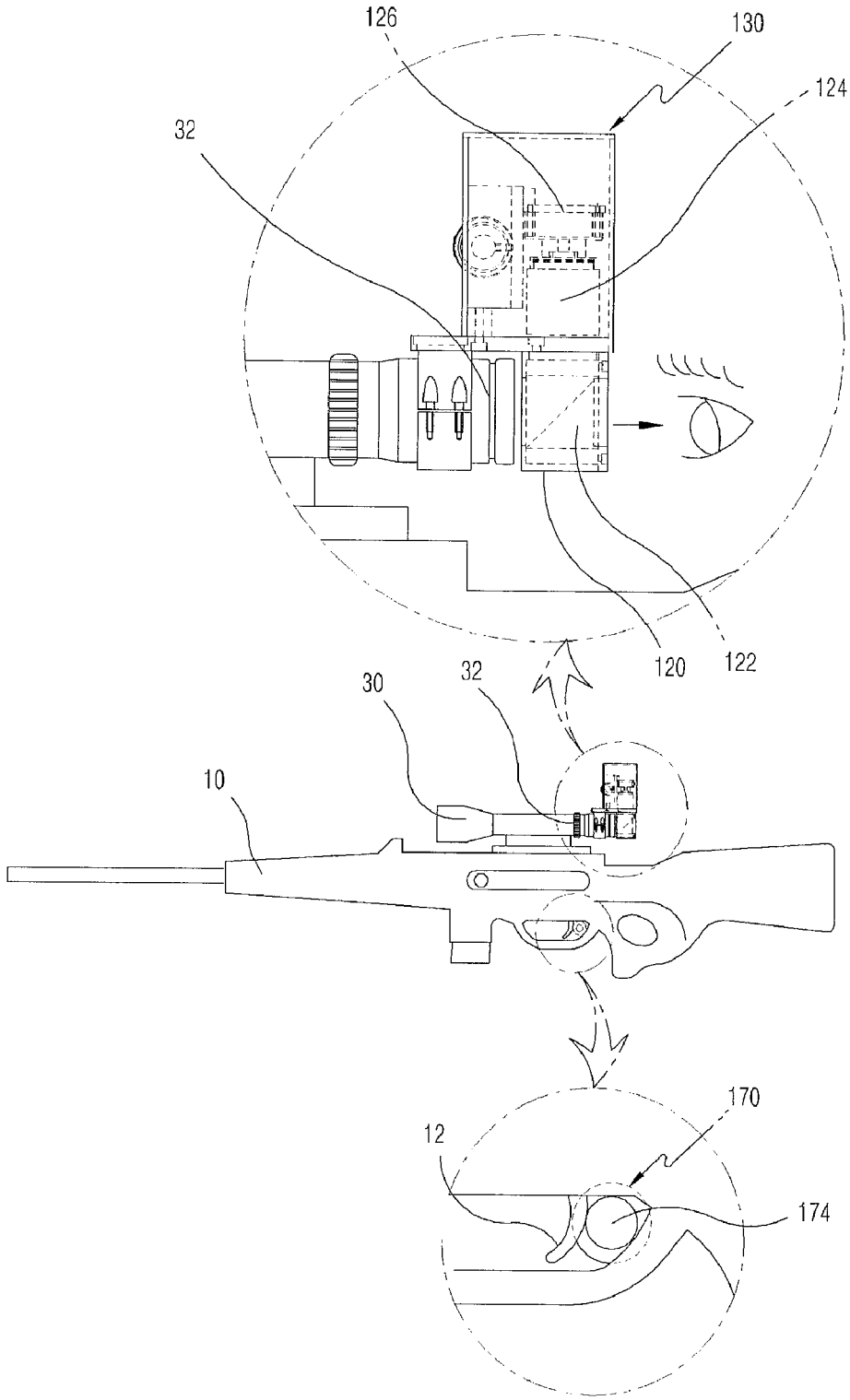
FIG. 3 is a diagram showing the firearm, the sighting telescope and the sighting camera unit of the integrated control system for controlling the aimed shooting of a sniper and the observation of a spotter according to the present invention.
Figure 4:
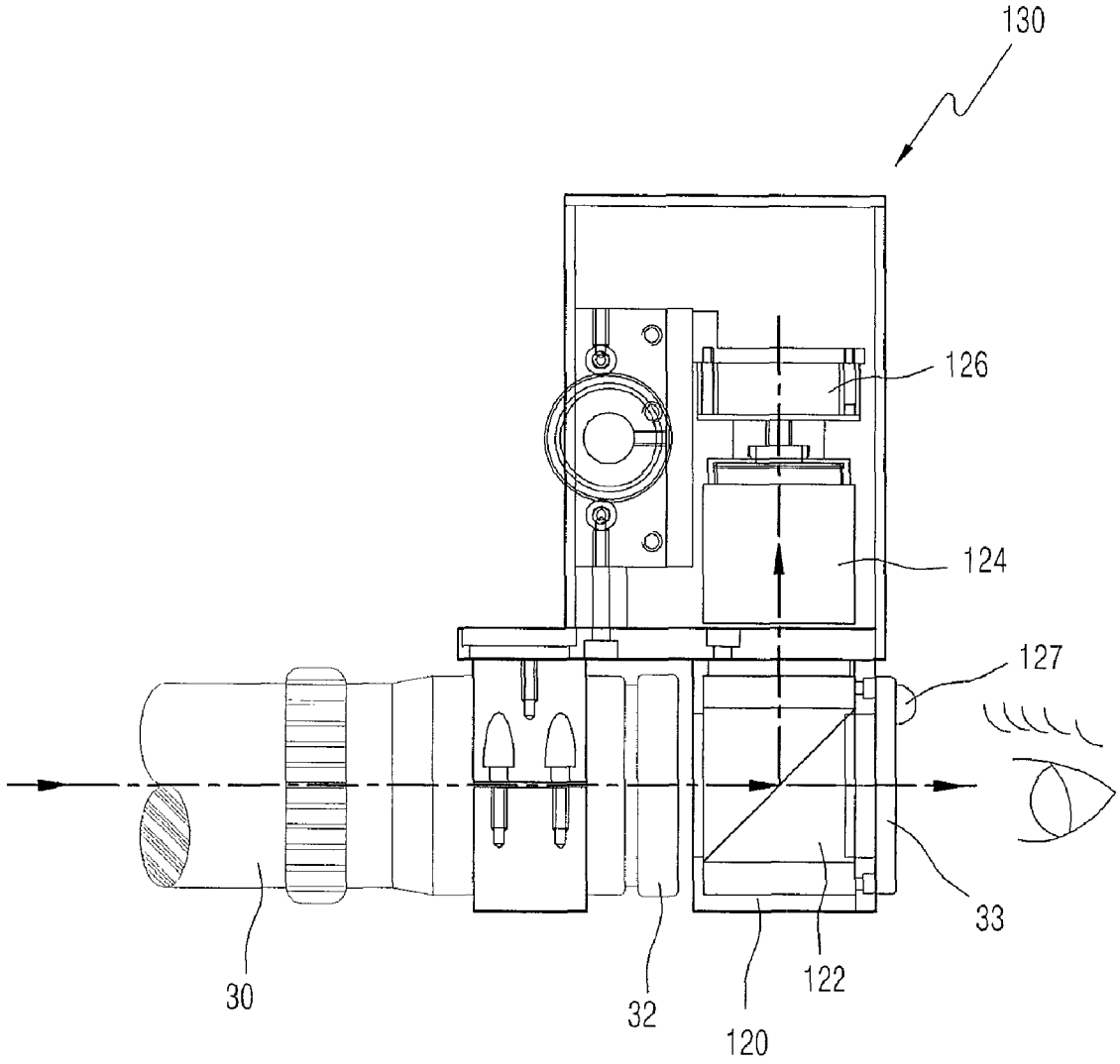
FIG. 4 is a detailed diagram showing a vertical sighting camera unit according to the present invention.

In FIGS. 3 and 4, a sniper in the shooting unit 110 directly checks images of the target 20, which receives 50% of the light passing through a prism (or a half mirror) 122 closely located on one side of the eyepiece 32 of the sighting telescope 30 by which the sniper directly identifies the target 20, via a second eyepiece 33 with his or her eye. Images of the target 20, which receive part of the remaining 50% of the light, are deflected by the prism (or the half mirror) 122 at an angle of 90° and are transmitted to the camera lens 124 of the reflection optical unit 120 of the sighting camera unit 130. The camera lens 124 desirably focuses the images and transmits the focused images to the image conversion module 126. The image conversion module 126 converts the images of the target 20 into digital moving image signals.

In this case, the sighting camera unit 130, which is mounted on the top of the firearm 10 while being connected to one side of the eyepiece 32 of the sighting telescope 30, includes the reflection optical unit 120, the camera lens 124, and the image conversion module 126, thus enabling the digital moving image signals of the target 20 identified by the sniper to be generated.

Further, in FIGS. 3 and 4, the sighting camera unit 130 is constructed in a vertical structure, so that there is an advantage in that the sighting camera unit 130 is structurally simplified using a single prism 122 included therein, but there is a disadvantage in that the height thereof increases.

Figure 5:
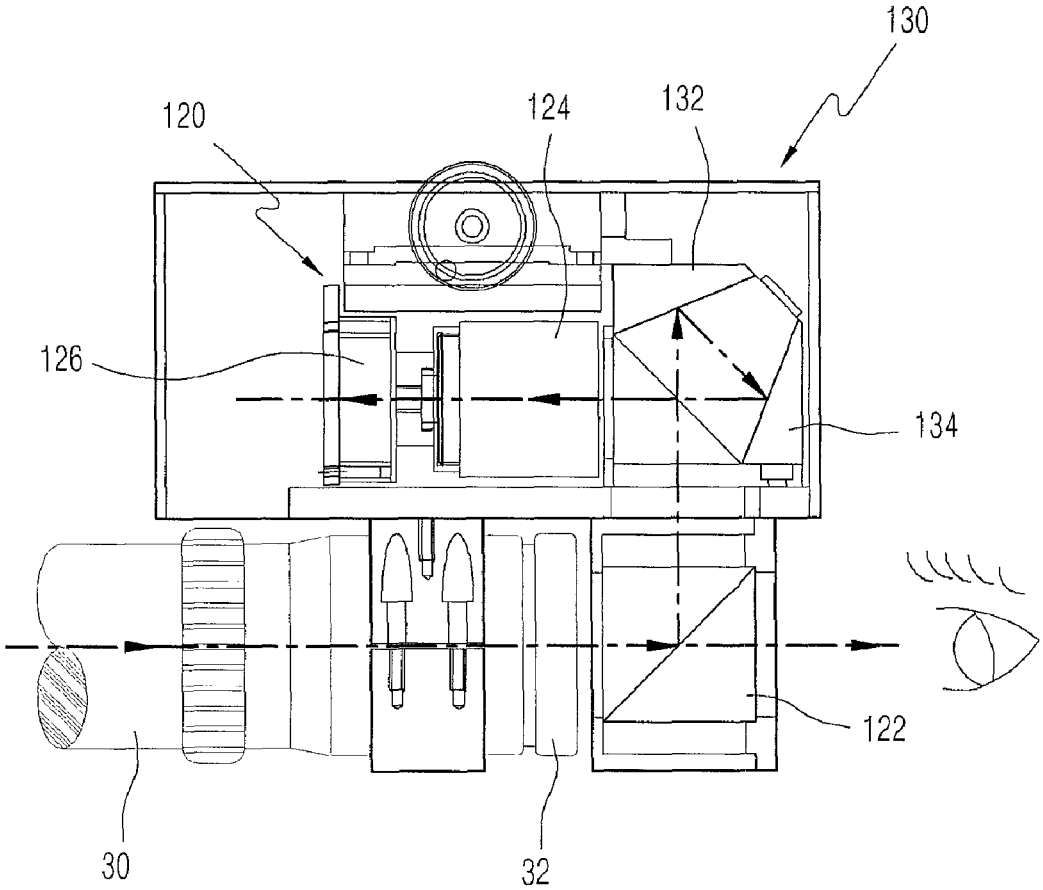
FIG. 5 is a detailed diagram showing a horizontal sighting camera unit according to the present invention.

Meanwhile, in another embodiment in which the reflection optical unit 120 is implemented using a plurality of lenses, the sighting camera unit 130 is constructed in a horizontal structure, as shown in FIG. 5, and thus the height thereof can be minimized.

Referring to this construction, the prism (or the half mirror) 122 having a reflective surface is closely mounted on one side of the eyepiece 32 of the sighting telescope 30 by which the sniper identifies the target 20 with his or her eye, and is then configured to receive images of the target 20 corresponding to part of the light and deflect the images at an angle of 90°.

Further, a second prism 132 installed in the sighting camera unit 130 and configured to receive the images from the prism (or the half mirror) 122 deflects again the images of the target 20 at a predetermined angle.

A third prism 134 configured to transmit the images of the target 20 received from the second prism 132 along a parallel path is located on one side of the second prism 132.

When the camera lens 124 receives the images of the target 20, directly provided by the third prism 134, and transmits the images to the image conversion module 126, the image conversion module 126 converts the analog images into digital moving image signals.

Such a sighting camera unit 130 composed of a plurality of lenses may be mounted on the top of the firearm 10. When the sighting camera unit 130 is implemented as a structure having a plurality of lenses, the height thereof can be decreased, and thus the sighting camera unit 130 has an advantage of realizing a low horizontal structure.

Further, a half mirror instead of the prism 122 may be disposed on one side of the eyepiece 32 of the sighting telescope 30 by which the sniper identifies the target 20, and may be configured to allow the images of the target 20 to be collected on and to be reflected towards the camera lens 124.

Furthermore, in the sighting camera unit 130, the image conversion module 126 may be implemented as another type of unit such as an infrared camera or a thermal camera in order to identify the target 20 even at night.

A method of implementing wireless communication between the wireless control transmission unit 160 and the shooting controller 140 at a distance of from several km to several hundreds of km can be variously used according to the circumstances. For example, images, sound, metadata, and radio control signals can be simultaneously transmitted using a long-distance direct transmission method based on Coded Orthogonal Frequency Division Multiplexing (COFDM), Orthogonal Frequency Division Multiplexing (OFDM) or a transmission method based on a WiFi network, a WiMAX (or Wibro) network, a Trunked Radio System (TRS) network, a Code Division Multiple Access (CDMA)/Global System for Mobile communications (GSM)/General Packet Radio Service (GPRS) mobile communication network, or a 3G High-Speed Downlink Packet Access (HSDPA) or 3G High-Speed Uplink Packet Access (HSUPA) satellite communication network.

The commander who directly views the images of the target 20 through the LCD monitor 142 of the shooting controller 140 with his or her eyes precisely identifies the target 20, analyzes the current situation of the spot, and transmits a shooting control signal to the shooting unit 110, thus controlling the approval/disapproval of a shoot command.

The shooting controller 140 is configured to receive the images of the target 20 from the shooting unit 110 through the wireless video transmitter 164, thus allowing the commander to view the images displayed on the LCD monitor 142. In addition, the shooting controller 140 is provided with a program for automatically analyzing the current situation of the spot, thus enabling the number of bullets, an azimuth angle between the sniper and the target, current effective shooting distance, target accuracy rate, etc. to be displayed on the screen of the LCD monitor 142.

The control unit 150, which issues a shoot command on the basis of the analyzed current situation while the images are viewed on the LCD monitor 142 of the shooting controller 140 in real time, is configured to remotely control the trigger locking unit 170 of the firearm of the sniper at the remote place.

Further, the shooting controller 150 is capable of storing all images transmitted from the sniper in internal or external memory, and enables the stored images to be played and viewed later.

Here, the wireless control transmission unit 160 is configured to connect the shooting unit 110 and the control unit 150 at the remote place to each other so that video/audio GPS metadata therebetween can be bidirectionally communicated in real time.

Figure 6:
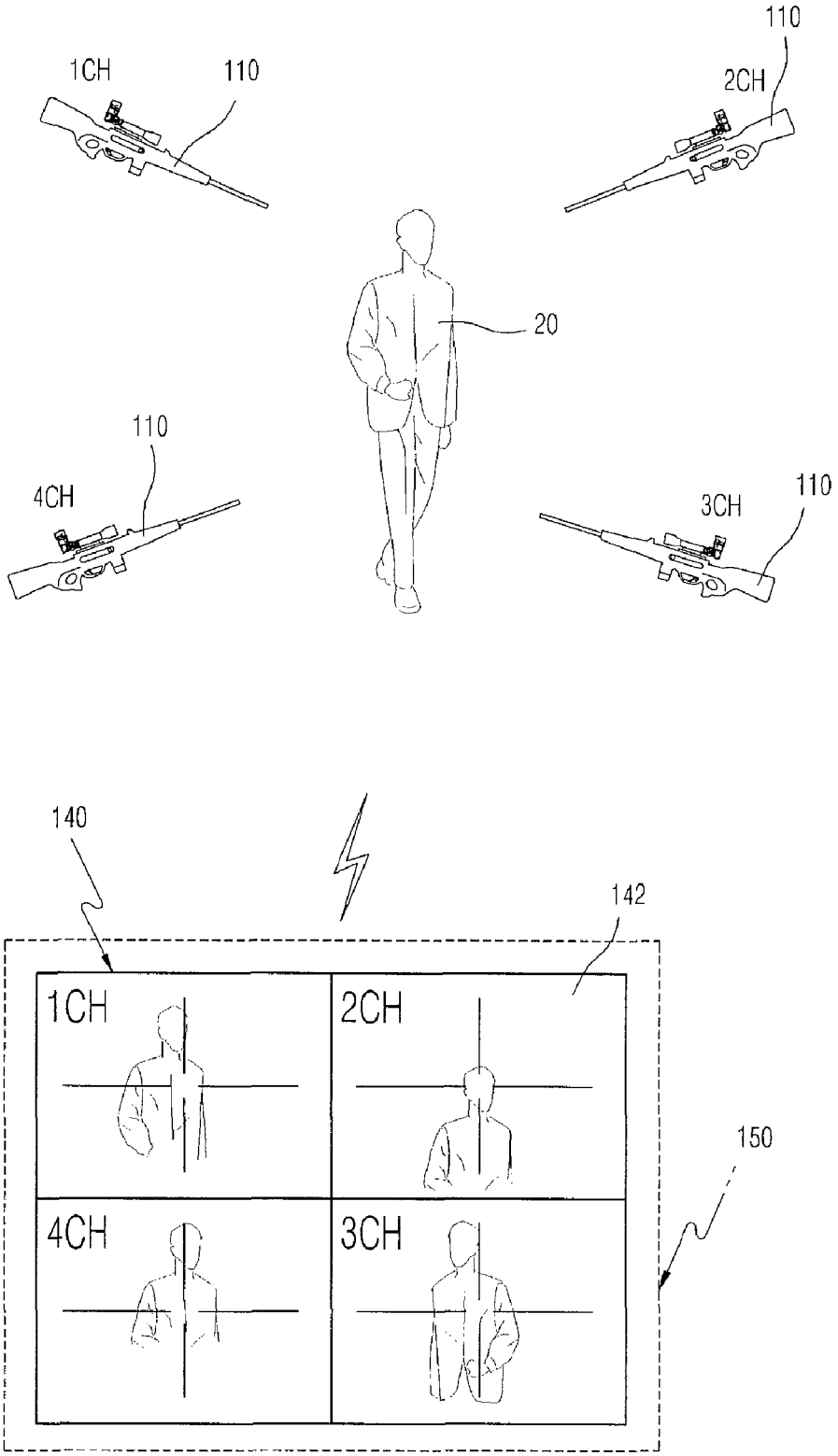
FIG. 6 is a diagram showing the disposition of a plurality of snipers in the integrated control system for controlling the aimed shooting of a sniper and the observation of a spotter according to another embodiment of the present invention.

Further, as shown in FIG. 6, when not one but a plurality of snipers is arranged, the channels of respective snipers are set up as multiple channels in the shooting controller 140, so that the screen of the LCD monitor 142 is divided into multiple channels, thus enabling the images of respective snipers to be viewed in real time.

For example, when there are four snipers, a channel for images is divided into four channels ranging from a first channel to a fourth channel and the four channels are assigned to the respective snipers. Therefore, the four channels obtained by division are set up in the shooting controller 140, so that video captured by respective snipers who identify the target 20 using their own sighting telescopes 30, and images of the surroundings of the target 20 captured by the spotter using the observatory telescope 40 can be viewed by the control unit 150 in real time in the form of a divided screen.

In addition, when a plurality of snipers is disposed and aims at the target 20, the control unit 150 at the remote place can determine which target is being aimed at by individual snipers and whether the snipers have precisely aimed at the target while viewing the images displayed on the monitor of the shooting controller 140 at the time of aiming at the target, and can integrally determine the current situation of the spot, thus controlling the issuing of a suitable shoot command, the adjustment of shooting positions, etc.

Figure 7:
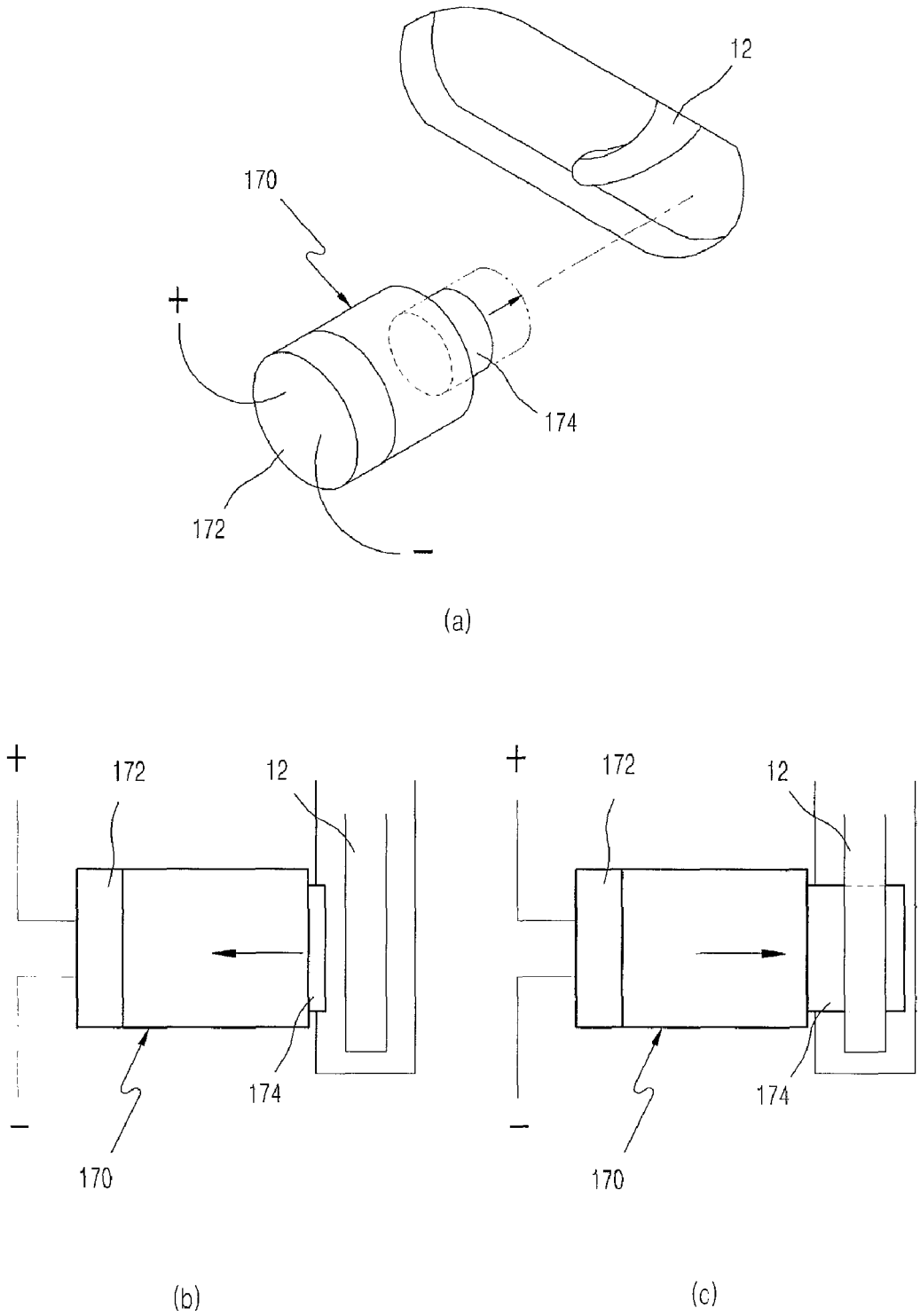
FIGS. 7A to 7C are diagrams showing the trigger locking unit, the electromagnetic coil control and the electromagnetic coil lock of the integrated control system for controlling the aimed shooting of a sniper and the observation of a spotter according to the present invention.

In this case, as shown in FIG. 7, in order to prevent each sniper from carelessly shooting at the target 20, a trigger locking unit 170 is provided on the trigger 12 of the firearm (rifle) of the sniper. Accordingly, when the commander at the remote place transmits a radio release signal to an electromagnetic coil control 172, provided in a portion of the rifle, through the wireless control transmission unit 160 so that the sniper can pull the trigger 12 only when a command approving shooting is issued, electricity is supplied to the electromagnetic control 172. As a result, an electromagnetic coil lock 174 retreats from its locked position and is released so that the trigger 12 can be pulled, thus enabling the determination of the approval or not of shooting to be controlled.

When the sniper aims at the target 20 and waits to shoot, the control unit 150 analyzes the shoot command. When the current target is determined to be a precise target 20, the shoot command is transmitted if an approval button 144 is pressed. Then, the electromagnetic coil lock 174 of the trigger locking unit 170 is released, and thus the sniper enters a shooting mode.

Figure 8:
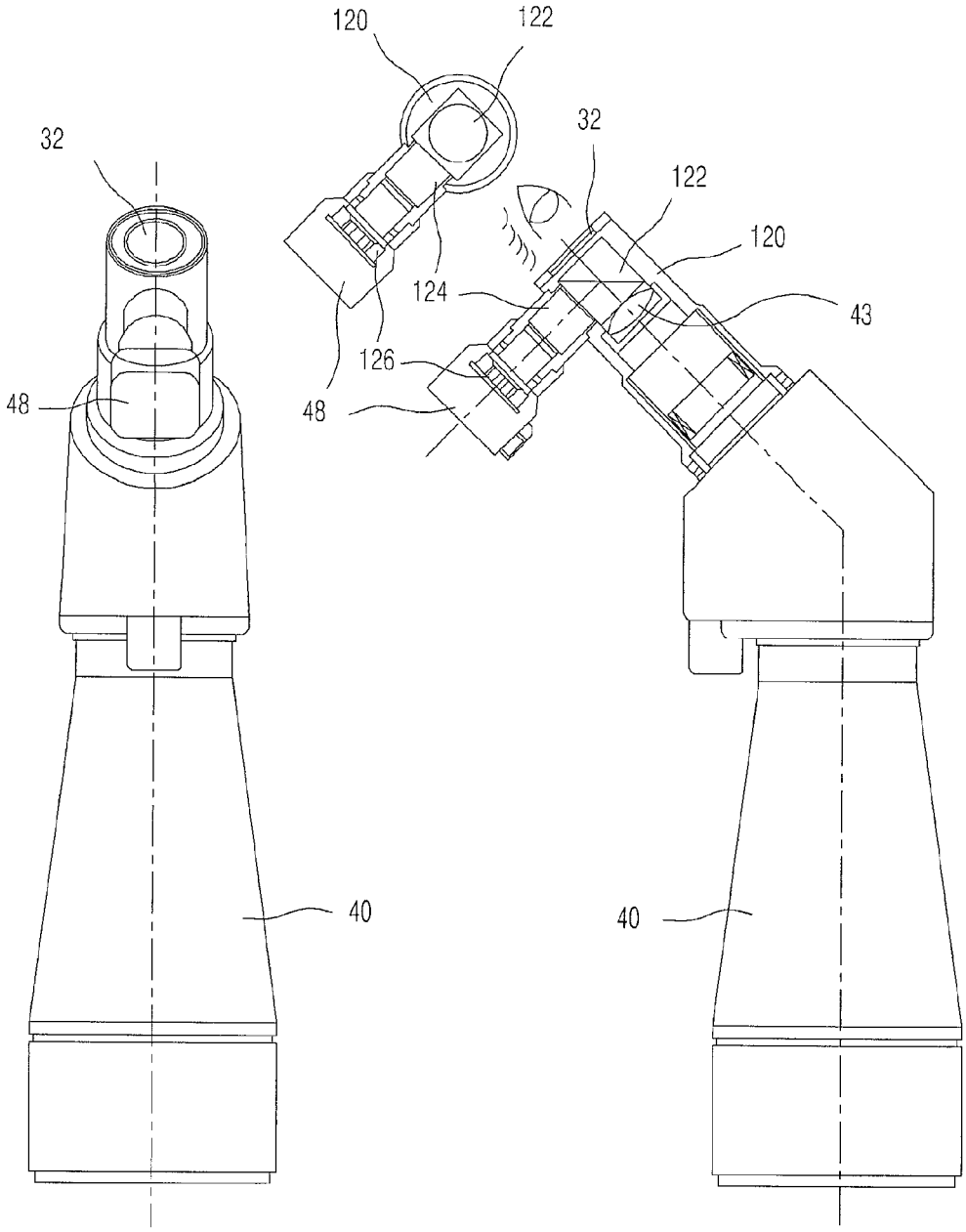
FIG. 8 is a detailed diagram showing the observatory telescope and the vertical observation camera unit of the integrated control system for controlling the aimed shooting of a sniper and the observation of a spotter according to a further embodiment of the present invention.

Further, in the system for controlling the shooting of a sniper according to the present invention, a further embodiment relates to an observatory telescope 40 which is used by the spotter and is configured to detect a location most suitable for shooting by observing surrounding environment in advance near the sniper, and to support safe shooting by checking the surroundings in advance, as shown in FIG. 8. Images of the target 20, which receive 50% of the light passing through a prism (or a half mirror) 122 closely located on the observation magnification lens 43 of the observatory telescope 40 by which the spotter directly identifies the target 20, are directly identified by the spotter through an eyepiece 32 with his or her eye. Images of the target 20, which receive part of the remaining 50% of the light, are deflected by the prism 122 at an angle of 90° and are transmitted to the camera lens 124 of the reflection optical unit 120 of an observation camera unit 48. The camera lens 124 desirably focuses the images, and transmits the focused images to an image conversion module 126.

Figure 9:
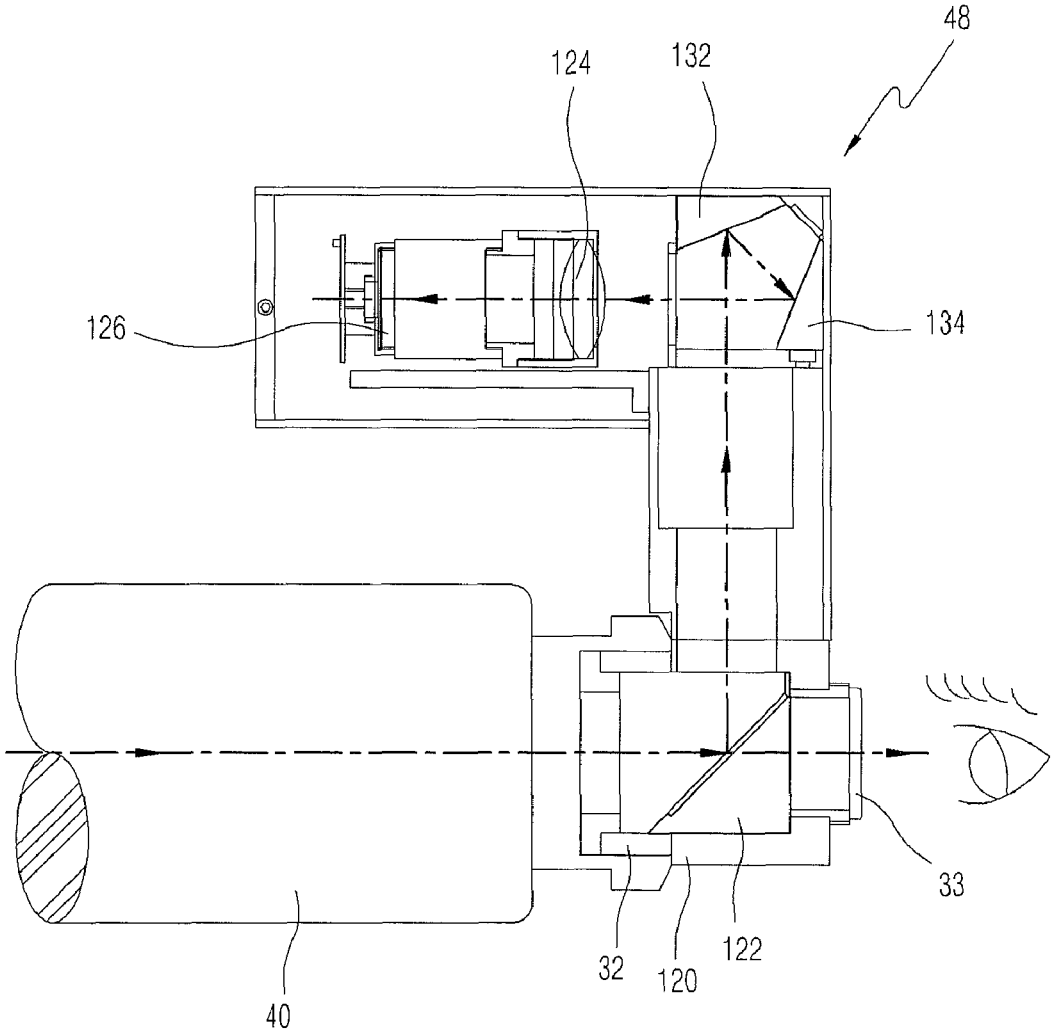
FIG. 9 is a detailed diagram showing the observatory telescope and the horizontal observation camera unit of the integrated control system for controlling the aimed shooting of a sniper and the observation of a spotter according to still another embodiment of the present invention.

The image conversion module 126 converts the images of the target 20 into digital moving image signals. Still another embodiment of the present invention relates to an observatory telescope 40, as shown in FIG. 9. Images of the target 20, which receive 50% of the light passing through a prism (or a half mirror) 122 closely located on the eyepiece 32 of the observatory telescope 40 by which the spotter directly identifies the target 20, are directly identified by the spotter through a second eyepiece 33 with his or her eye. Images of the target 20, which receive part of the remaining 50% of the light, are deflected by the prism 122 at an angle of 90°, and the deflected images are deflected again by a second prism 132 and a third prism 134. The deflected images are transmitted to the camera lens 124 of the reflection optical unit 120 of an observation camera unit 48. The camera lens 124 desirably focuses the images of the target 20, and transmits the focused images to an image conversion module 126. The image conversion module 126 converts the images of the target 20 into digital moving image signals.

Hereinafter, a method of controlling the shooting of a sniper in the above-described system will be described in detail with reference to the attached drawings.

Figure 10:
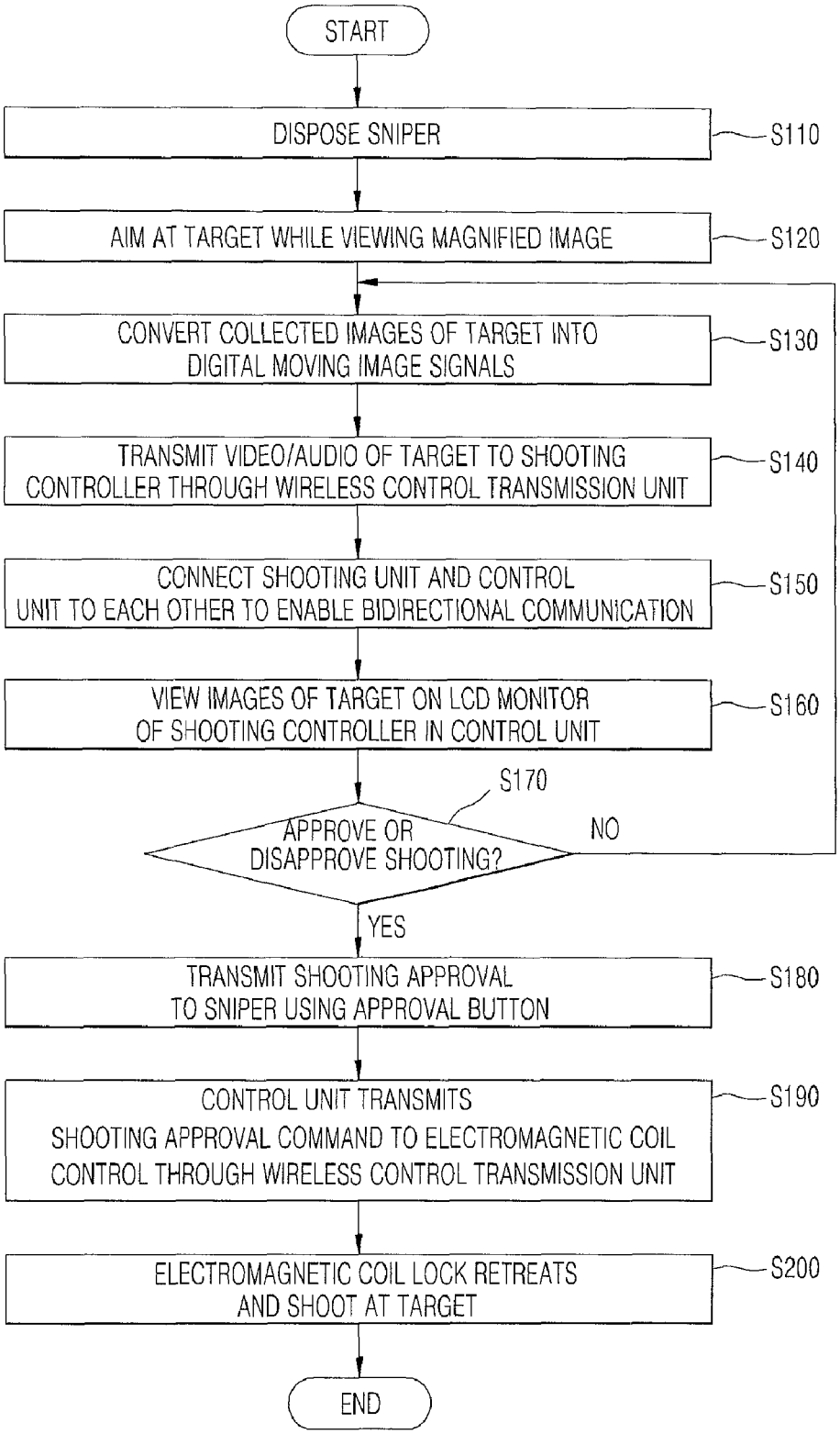
FIG. 10 is a flowchart showing a method of controlling the shooting of a sniper according to the present invention.

FIG. 10 is a flowchart showing only a method of controlling the shooting of a sniper in the system for controlling the aimed shooting of a sniper and the observation of a spotter according to the present invention.

As shown in the drawing, in the shooting control method according to the present invention, a sniper who identifies the location of a target 20 and will shoot at the target while aiming at the target 20 with his or her firearm is disposed at step S110.

Further, the sniper aims at the target 20 while viewing a magnified image of the target 20 using the second eyepiece 33 of a sighting camera unit 130 attached to a sighting telescope 30 provided on the firearm 10 at step S120.

The sniper identifies the target 20 and collects images of the target 20 using the second eyepiece 33, and part of the images of the target 20 are transmitted to the camera lens 124 through the prism 122 of the reflection optical unit 120, and are converted into digital moving image signals by the image conversion module 126 at step S130.

That is, the sighting camera unit 130 is configured such that the prism 122 is located on one side of the eyepiece 32 of the sighting telescope 30 by which the sniper identifies the target 20 and is configured to receive the images of the target 20 corresponding to part of the light and deflect the images at an angle of 90°. Further, the camera lens 124 receives images of the target 20, directly provided by the prism 122, and the image conversion module 126 converts the analog images into digital video signals, and thus the digital target video signals are transmitted to a shooting controller 140 of a commanding office located at the remote place through a wireless control transmission unit 160 at step S140.

In this case, the wireless control transmission unit 160 connects a shooting unit 110 and a control unit 150 located at the remote place to each other so that video/audio and shooting control signals can be bidirectionally communicated in real time at step S150.

Next, the images of the target 20 are output to the LCD monitor 142 of the shooting controller 140 and can be viewed in real time by the control unit 150 at step S160.

The control unit 150 determines whether to approve or disapprove shooting in such a way that the commander detects the precise location of the target 20 and is aware of a time of shooting while viewing the video of the target 20 displayed on the LCD monitor 142 of the shooting controller 140, and then transmits a command corresponding to a shoot approval signal to the wireless control transmission unit 160 of the shooting unit 110 at step S170.

At this time, when the commander presses an approval button 144 provided on a portion of the shooting controller 140, the shoot approval command is sent to the sniper at step S180.

The control unit 150 transmits the shoot approval command to the electromagnetic coil control 172 mounted on the firearm 10 through the wireless control transmission unit 160 at the time of issuing a shoot command at step S190.

Furthermore, the electromagnetic coil control 172 transmits a radio release signal in compliance with the shoot approval command, so that the electromagnetic coil lock 174 of the trigger locking unit 170 retreats from its locked position, and thus the sniper views the turn-on operation of the release indication lamp 127 and shoots at the target 20 in a locking release state by pulling the trigger 12 at step S200.

In detail, the trigger locking unit 170 is provided on the trigger 12 of the rifle of the sniper to prevent the sniper from carelessly shooting at the target 20. Therefore, shooting can be controlled using the trigger locking unit 170 in such a way that when the radio release signal is transmitted to the electromagnetic coil control 172, provided on a portion of the rifle, through the wireless control transmission unit 160 so that the sniper can pull the trigger 12 only when the commander at the remote place issues a shoot approval command, electricity is supplied to the electromagnetic coil control 172, and thus the trigger 12 can be pulled as the electromagnetic coil lock 174 has retreated from its locked position.

The trigger locking unit 170 is configured such that the electromagnetic coil lock 174, which can reciprocate forwards and backwards in the trigger locking unit 170 via the electromagnetic coil control 172 electrically controlled by an electromagnet, is installed. Accordingly, when electricity is supplied to the electromagnetic coil control 172, the electromagnetic coil lock 174 retreats and the locked state of the trigger is released. In contrast, when electricity is not supplied, the electromagnetic coil lock 174 is caught in the back of the trigger 12 to prevent the movement of the trigger 12 and maintain the locked state of the trigger so that firing cannot occur.

In this case, the shoot approval command issued by the control unit 150 is transmitted in such a way that when the approval button 144, provided on a portion of the shooting controller 140, is pressed, an approval signal for approving shooting is transmitted to the wireless control transmission unit 160, and the wireless control transmission unit 160 transmits the approval signal to the electromagnetic coil control 172.

As described above, the integrated control system and method for controlling the aimed shooting of a sniper and the observation of a spotter according to the present invention proposes a scheme for controlling the shooting of a sniper, which transmits video of a target 20 formed by the sighting telescope 30 to the shooting controller 140 of a commanding office located at a remote place through the wireless control transmission unit 160 in a wireless manner, reports the current situation of the target 20 to the shooting controller 140 in the form of video of the target 20, and helps the commander make a decision pertaining to shooting.

Accordingly, the present invention is advantageous in that real-time shooting control is possible because a commanding office performs aiming and shooting control in a wireless manner at a remote place, and in that wireless remote control is possible to enable the situation of a spot to be directly viewed using real-time video of the operational situation of the spot.

Further, the present invention is advantageous in that a sniper, who aims at a target with a firearm and will shoot at the target, wirelessly reports the current situation of the target, in the form of moving images enabling real-time viewing, to the shooting controller of a commanding office located at a remote place while checking the shape of the target formed by a sighting telescope, and in that the commanding office can issue a precise shoot command.

In this way, the present invention is advantageous in that real-time images are mutually checked by both a sniper and a commander, so that the occurrence of accidental firing can be minimized, thus not only ensuring safety but also maximizing shooting efficiency.

Furthermore, the present invention is advantageous in that since the safety of the place where a sniper is disposed and the surroundings of a target can be widely grasped, a situation indicating whether the sniper has precisely hit the target at the time of shooting at the target can be observed at a remote place while the position of the sniper can be prevented from being leaked to the other party, so that spot shooting and observation commands are possible at the remote place, thus greatly contributing to the development of operation systems based on advanced Information Technology (IT) equipment.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An integrated control system for controlling aimed shooting of a sniper and observation of a spotter, comprising:

a sighting camera unit for allowing a sniper, who aims at a target with a firearm and will shoot at the target, to check a shape of the target formed by a sighting telescope while viewing the shape through a second eyepiece, for deflecting images of the target using a first prism of a reflection optical unit closely located on a first side of a first eyepiece of the sighting telescope at an angle of 90°, for focusing the images using a camera lens, and for generating image signals using an image conversion module;

an observation camera unit for allowing a spotter, who widely grasps safety of a place where the sniper is disposed and surroundings of the target and observes whether the sniper has precisely hit the target at a time of shooting at the target while preventing the sniper's position from being leaked to another party, to identify the target and the surroundings of the target using an observatory telescope while viewing them through a first eyepiece, for deflecting images of the target and the surroundings at an angle of 90° using a first prism of a reflection optical unit closely located on a first side of an observation magnification lens, for focusing the images using a camera lens, and for generating image signals using an image conversion module;

a multiplexer for allowing two types of moving images acquired by the sighting camera unit and the observation camera unit to be selectively transmitted by the sniper or the spotter by manipulating channel selection switches of a wireless control transmission unit, and dividing video obtained through two channels into images for multiple screens;

the wireless control transmission unit for transmitting digital moving images in real time to a shooting controller of a commanding office at a remote place through a wireless image transmitter while the video are viewed on a small-sized monitor of the wireless control transmission unit;

a shooting controller disposed in a control unit of the commanding office at the remote place and configured to receive video of the target aimed at by the sniper and video of a situation of a spot captured by the spotter;

the control unit for transmitting a trigger lock release signal in a wireless manner when a commander of the commanding office makes a precise decision pertaining to shooting and then presses an approval button of the shooting controller while issuing a shoot command via remote control; and a trigger locking unit for controlling an electromagnetic lock, which has blocked pulling of a trigger of the firearm using a force of an electromagnet, when the wireless control transmission unit receives the trigger lock release signal from the shooting controller.

2. The integrated control system according to claim 1, wherein the sighting camera unit is constructed in a vertical structure and is configured such that it allows the sniper to check the shape of the target formed by the sighting telescope while viewing the shape through the second eyepiece, deflects the images of the target using the first prism of the reflection optical unit closely located on the first side of the first eyepiece of the sighting telescope at an angle of 90°, focuses the images using the camera lens, and generates the image signals using the image conversion module.

3. The integrated control system according to claim 1, wherein the sighting camera unit is configured such that:

images of the target which receive 50% of light passing through the first prism closely located on the first eyepiece of the sighting telescope by which the sniper directly identifies the target are directly identified by the sniper through the second eyepiece with his or her eye, and images of the target which receive part of remaining 50% of the light are deflected by the first prism at an angle of 90° and are transmitted to the camera lens of the reflection optical unit of the sighting camera unit, the camera lens desirably focuses the images and transmits the focused images to the image conversion module, and the image conversion module converts the images of the target into digital moving image signals, and the first prism having a reflective surface is closely disposed on the first side of the first eyepiece of the sighting telescope by which the sniper identifies the target with his or her eye, and is configured to receive the images of the target corresponding to part of the light and deflect the images at an angle of 90°.

4. The integrated control system according to claim 3, wherein the sighting camera unit is constructed in a horizontal structure comprising a plurality of prisms, comprising:

a second prism installed in the sighting camera unit and configured to deflect again the images of the target received from the first prism at a predetermined angle; and a third prism disposed on a first side of the second prism and configured to transmit the images of the target received from the second prism along a parallel path, wherein when the camera lens of the sighting camera unit receives the images of the target directly provided by the third prism and transmits the images to the image conversion module, the image conversion module generates the digital video signals by converting the analog video into the digital video signals.

5. The integrated control system according to claim 1, wherein the observation camera unit is configured such that it allows the spotter, who widely grasps the safety of the place where the sniper is disposed and the surroundings of the target and observes whether the sniper has precisely hit the target at a time of shooting at the target while preventing the sniper's position from being leaked to another party, to identify the target and the surroundings of the target using the observatory telescope while viewing them through a second eyepiece, deflects the images of the target and the surroundings at an angle of 90° using the first prism of the reflection optical unit closely located on the first side of the observation magnification lens, focuses the images using the camera lens, and generates the image signals using the image conversion module.

6. The integrated control system according to claim 1, wherein a half mirror instead of the first prism is located on the first side of the first eyepiece of the sighting telescope by which the sniper identifies the target, thus enabling images of the target to be collected on and reflected towards the camera lens.

7. The integrated control system according to claim 1, wherein the sighting camera unit is configured such that the image conversion module thereof is implemented as an infrared camera or a thermal camera to identify the target even at night.

8. The integrated control system according to claim 1, wherein the wireless control transmission unit is constructed such that two types of video captured by the sighting camera unit and the observation camera unit are selectively transmitted by the sniper or the spotter by manipulating channel selection switches of the wireless control transmission unit and such that the digital video signals are transmitted in real time to the shooting controller of the commanding office located at the remote place at a distance of from several km to several hundreds of km by using the multiplexer, which is capable of dividing the video obtained by two types of channels into images for multiple screens, and the wireless image transmitter while the digital moving image signals are viewed on the small-sized monitor of the wireless control transmission unit.

9. The integrated control system according to claim 1, wherein the shooting controller is configured such that, when one sniper and a plurality of spotters are disposed, moving images transmitted by the sniper and the spotters through the wireless image transmitter are displayed on a Liquid Crystal Display (LCD) monitor of the shooting controller of the commanding office at the remote place with a screen of the LCD monitor divided into screens for multiple channels, and are viewed in real time through corresponding channels of the sniper and the spotters.

10. The integrated control system according to claim 1, wherein the shooting controller is capable of storing all images transmitted by the sniper in internal or external memory, enables the images to be played and viewed later, and comprises the wireless control transmission unit for connecting a shooting unit and the control unit located at the remote place to each other so that video/audio and GPS metadata therebetween can be bidirectionally communicated.

11. The integrated control system according to claim 1, wherein transmission equipment for video, audio and GPS metadata is provided to include the wireless control transmission unit therein, the wireless control transmission unit being configured to receive individual moving images through two or more types of channels of the sighting camera unit and the observation camera unit and to selectively transmit the video/audio by manipulating a plurality of channel selection switches, and configured to transmit in real time the digital video/audio signals to the commanding office located at the remote place at a distance of from several km to several hundreds of km by using the multiplexer, which is capable of dividing the moving images obtained by the two or more types of channels into images for multiple screens, and the wireless image transmitter while the digital moving image signals are viewed on the small-sized monitor of the wireless control transmission unit when the sniper is moving and loaded on a helicopter, an airplane, land transportation means, a patrol boat, or a ship.

12. The integrated control system according to claim 1, wherein the trigger locking unit is configured such that when the trigger lock release signal is received from the shooting controller in a state in which the trigger locking unit is provided on the trigger of the firearm of the sniper to prevent the sniper from carelessly shooting at the target, the electromagnetic coil lock retreats from its locked position and a trigger lock function is released at a same time that the trigger lock release signal is transmitted to an electromagnetic coil control of the trigger locking unit for controlling the electromagnetic coil lock which has blocked pulling of the trigger using a force of an electromagnet.

13. The integrated control system according to claim 1, further comprising a release indication lamp located on a top of the second eyepiece of the sighting camera unit, and configured such that when the trigger lock release signal is received from the shooting controller in a state in which the trigger locking unit is provided on the trigger of the firearm of the sniper to prevent the sniper from carelessly shooting at the target, the release indication lamp is turned on, and shooting at the spot is controlled via remote control by the commanding office at the remote place in such a way that the sniper recognizes that the trigger locking unit has been released and can shoot at the target by pulling the trigger.

14. The integrated control system according to claim 1, wherein the wireless control transmission unit and the shooting controller perform wireless communication at a distance of from several km to several hundreds of km therebetween using various methods according to circumstances, and images/sound/metadata and radio control signals are simultaneously transmitted using a long-distance direct transmission method based on Coded Orthogonal Frequency Division Multiplexing (COFDM), Orthogonal Frequency Division Multiplexing (OFDM) or a transmission method based on a WiFi network, a WiMAX (or Wibro) network, a Trunked Radio System (TRS) network, a Code Division Multiple Access (CDMA)/Global System for Mobile communications (GSM)/General Packet Radio Service (GPRS) mobile communication network, or a 3G High-Speed Downlink Packet Access (HSDPA) or 3G HSUPA satellite communication network.

15. The integrated control system according to claim 1, wherein the shooting controller is configured such that the commander who is directly viewing the images of the target on a Liquid Crystal Display (LCD) monitor of the shooting controller can control approval/disapproval of a shoot command by precisely identifying the target, analyzing the situation of the spot and transmitting a shooting control signal to a shooting unit and such that the images of the target are received from the shooting unit through the wireless video/audio transmitter to allow the commander to view the images displayed on the LCD monitor, and the shooting controller is provided with a program for automatically analyzing the situation of the spot to enable a number of bullets, an azimuth angle between the sniper and the target, current effective shooting distance, target accuracy rate, etc. to be displayed on a screen of the LCD monitor.

16. The integrated control system according to claim 11, wherein the wireless control transmission unit is configured such that when Radio Detection And Ranging (RADAR) equipment, Sound Navigation and Ranging (SONAR) equipment for sound wave measurement, a Pan Tilt Zoom (PTZ) camera, an infrared camera or a thermal camera is mounted in a helicopter or an airplane and the sniper gets on the helicopter or the airplane and conducts an operation, moving images can be received through multiple channels and can be selectively transmitted by manipulating the channel selection switches, and the multi-channel moving images can be separately transmitted or selectively transmitted through the multiplexer which is capable of dividing a screen into multiple screens, and such that the digital video image signals are transmitted in real time to the commanding office, located at the remove place at a distance of from several km to several hundreds of km, through the wireless video/audio transmitter while being viewed on the small-sized monitor of the wireless control transmission unit.

17. An integrated control method of controlling aimed shooting of a sniper and observation of a spotter, comprising:

disposing a sniper who identifies a location of a target and will shoot at the target while aiming at the target with a firearm;

allowing the sniper to aim at the target while viewing a magnified image of the target using a second eyepiece of a sighting camera unit attached to a sighting telescope provided on the firearm;

allowing the sniper to identify the target using the second eyepiece and collect images of the target, transmitting part of the images of the target to a camera lens through a first prism of a reflection optical unit of the sighting camera unit, and allowing an image conversion module to convert the images of the target into digital video image signals;

locating the prism on a first side of a first eyepiece of the sighting telescope by which the sniper identifies the target, receiving images of the target corresponding to part of light and deflecting the images at an angle of 90° using the prism, allowing the camera lens to receive the images of the target, directly provided by the prism, allowing the image conversion module to convert analog images into digital moving image signals, and transmitting the digital moving image signals of the target to a shooting controller of a commanding office located at a remote place through a wireless control transmission unit;

connecting a shooting unit connected to the wireless control transmission unit and a control unit located at the remote place to each other so that Video/Audio and shooting control signals therebetween are bidirectionally communicated in real time;

Display the images of the target on a Liquid Crystal Display (LCD) monitor of the shooting controller and enabling the images of the target to be viewed in real time by the control unit;

the control unit determining whether to approve or disapprove shooting in such a way that a commander detects a precise location of the target and is aware of a time of shooting while viewing the images of the target on the LCD monitor of the shooting controller, and then transmitting a shooting approval signal to the wireless control transmission unit of the shooting unit;

when the commander presses an approval button provided on a portion of the shooting controller, transmitting a shoot approval command to the sniper;

when the control unit issues a shoot command, transmitting the shoot command to an electromagnetic coil control mounted on the firearm through the wireless control transmission unit; and the electromagnetic control transmitting a radio release signal in compliance with the shoot approval command, and retreating an electromagnetic coil lock of a trigger locking unit from its locked position, so that the sniper views a turn-on operation of a release indication lamp and shoots at the target in a locking release state by pulling the trigger.

* * * * *